US008152487B2

(12) United States Patent
Watanabe et al.

(10) Patent No.: US 8,152,487 B2
(45) Date of Patent: Apr. 10, 2012

(54) INVERTER-INTEGRATED ELECTRIC COMPRESSOR

(75) Inventors: Takayuki Watanabe, Aichi (JP); Manabu Suzuki, Aichi (JP); Yuki Ichise, Aichi (JP); Yukihiro Sakaguchi, Aichi (JP); Takeshi Hirano, Aichi (JP); Akinori Yoshioka, Aichi (JP); Takayuki Hagita, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 512 days.

(21) Appl. No.: 12/442,049

(22) PCT Filed: Sep. 18, 2008

(86) PCT No.: PCT/JP2008/066876

§ 371 (c)(1),
(2), (4) Date: Mar. 19, 2009

(87) PCT Pub. No.: WO2009/038141

PCT Pub. Date: Mar. 26, 2009

(65) Prior Publication Data

US 2010/0018244 A1 Jan. 28, 2010

(30) Foreign Application Priority Data

Sep. 21, 2007 (JP) ..... 2007-245137

(51) Int. Cl.
*F04B 17/00* (2006.01)

(52) U.S. Cl. ..... 417/363; 417/410.1; 417/411

(58) Field of Classification Search ..... 417/363, 417/410.1, 411
See application file for complete search history.

(56) References Cited

FOREIGN PATENT DOCUMENTS

| | | | |
|---|---|---|---|
| JP | 4-321259 | A | 11/1992 |
| JP | 4-358776 | A | 12/1992 |
| JP | 11-107960 | A | 4/1999 |
| JP | 2003-153552 | A | 5/2003 |
| JP | 2004-138019 | A | 5/2004 |
| JP | 2006-316754 | A | 11/2006 |
| JP | 3845769 | B2 | 11/2006 |

OTHER PUBLICATIONS

International Search Report of PCT/JP2008/066876, date of mailing date Nov. 4, 2008.

*Primary Examiner* — Vip Patel
(74) *Attorney, Agent, or Firm* — Westerman, Hattori, Daniels & Adrian, LLP

(57) ABSTRACT

An inverter-integrated electric compressor that is capable of solving various problems caused by thermal expansion of a gel material filled inside an inverter accommodating section for vibration prevention and moisture prevention and capable of increasing reliability is provided. In the inverter-integrated electric compressor, an inverter accommodating section (11) is integrated with a periphery of a housing (2) accommodating an electric compressor; an inverter device (20) is accommodated inside the inverter accommodating section; a gel material (30) for vibration prevention and moisture prevention is filled in the upper section thereof so as to leave an air layer (31); an upper opening in the inverter accommodating section is sealed with a cover member (18); and a vent valve (40) formed of a moisture-permeable waterproof membrane (42) is provided in the cover member.

9 Claims, 5 Drawing Sheets

INVERTER-INTEGRATED ELECTRIC COMPRESSOR

TECHNICAL FIELD

The present invention relates to an inverter-integrated electric compressor that is integrated with an inverter device suitable for use as an air conditioning compressor installed in a vehicle.

BACKGROUND ART

An inverter-integrated electric compressor has an inverter accommodating section (inverter box) integrated with the periphery of a housing, which accommodates an electric motor and a compressing mechanism. The inverter accommodating section accommodates an inverter device that converts DC power received from a power supply, such as a generator or a battery, into three-phase AC power and supplies it to the electric motor. The inverter device includes high-voltage components, such as a head capacitor or an inductor; a power board provided with a plurality of semiconductor power switching devices and a power-system controlling circuit that operates the semiconductor power switching devices; a CPU board on which is mounted a circuit having devices that operate at low voltage, such as a CPU; and a bus-bar assembly which includes a plurality of integrated bus bars, constituting the electrical wiring inside the inverter device, and which is composed of insert-molded insulating resin material.

Since such an inverter-integrated electric compressor is mounted and used inside an engine compartment of a vehicle, it is used in an environment having a temperature change from a low temperature of several tens of degrees Celsius below zero to a high temperature of a several tens of degrees Celsius above 100° C. Therefore, in order to guarantee operation by protecting the various types of electrical equipments (electrical components and electronic components) constituting the inverter device from the surrounding environment, heat protection and water drop protection against condensation are required in addition to vibration protection.

Accordingly, it has been proposed to enclose a gel material or a resin material, such as silicone gel, inside the inverter accommodating section (inverter box) accommodating the inverter device up to at least a level where the electrical equipments are covered (for example, refer to Patent Documents 1 and 2).

Patent Document 1

Japanese Unexamined Patent Application, Publication No. 2006-316754

Patent Document 2

Publication of Japanese Patent No. 3845769

DISCLOSURE OF INVENTION

As described above, by enclosing a gel material or a resin material in the inverter accommodating section, the electrical equipments constituting the inverter device can be electrically insulated and protected. At the same time, the entry of water drops and transmission of vibrations to the electrical equipments can be prevented, and durability and reliability for the use environment can be improved. However, with the above-described configuration, when the enclosed gel material and inner air inside the inverter accommodating section thermally expand due to a rise in the ambient temperature, the inner pressure of the inverter accommodating section increases, and repeated stress caused by the inner pressure applies a load to the cover member sealing the inverter accommodating section and the components of the inverter device. Therefore, the cover member seal may be broken, and the components of the inverter device may be damaged.

The above-described problem caused by an increase in the inner pressure due to thermal expansion may be solved by reducing the infill amount of the gel material or by providing a vent port. However, it is not desirable to reduce the infill amount of the gel material because its effectiveness will also be reduced. With a typical vent port, it is difficult to release the inner pressure and water vapor generated inside the inverter device while preventing water from entering from the outside. Therefore, there is a need for a practical solution for solving the above-described problems caused by thermal expansion of the inner air and the gel material filled for vibration protection and moisture protection.

The present invention has been conceived in light of the circumstances described above, and it is an object of the present invention to provide an inverter-integrated electric compressor capable of solving various problems caused by thermal expansion of the gel material enclosed inside the inverter accommodating section for vibration protection and moisture protection, as well as improving reliability.

To solve the problems described above, the inverter-integrated electric compressor according to the present invention provides the following solutions.

Specifically, in an inverter-integrated electric compressor according to an aspect of the present invention, an inverter accommodating section is integrated with a periphery of a housing accommodating an electric compressor; an inverter device is accommodated inside the inverter accommodating section; a gel material for vibration prevention and moisture prevention is filled in the upper section thereof so as to leave an air layer; an upper opening in the inverter accommodating section is sealed with a cover member; and a vent valve formed of a moisture-permeable waterproof membrane is provided in the cover member.

According to this aspect, since the vent valve constructed of the moisture-permeable waterproof membrane is provided on the cover member that seals the inverter accommodating section, water can be prevented from entering from the outside into the inverter accommodating section, and, at the same time, the pressure rise generated inside the inverter accommodating section due to the thermal expansion of water vapor and inner air and the gel material caused by a rise in the ambient temperature can be released outside through the moisture-permeable waterproof membrane constituting the vent valve. In this way, while sufficiently providing the original functions of the gel material, such as vibration prevention and moisture prevention, at the same time, breaking of the seal provided by the cover member and damage to various components constituting the inverter device due to stress generated when thermal expansion of the gel material occurs can be prevented. Therefore, the reliability of the inverter-integrated electric compressor can be improved. The moisture-permeable waterproof membrane allows air and water vapor to pass through but does not allow water to pass through. Typical examples of the moisture-permeable waterproof membrane are Gore-Tex (trademark), manufactured by W. L. Gore & Associates, Inc. in the USA, which is a porous fluorocarbon resin membrane composed by hybridizing polytetrafluoroethylene (PTFE) and polyurethane polymers, and DiAPLEX (trademark), manufactured by Diaplex Co. Ltd., which is a polyurethane based shape-memory resin.

In the inverter-integrated electric compressor according to the above-described aspect, the vent valve may be configured so that a venting hole provided in the cover member is covered with the moisture-permeable waterproof membrane.

In this way, the vent valve can be constructed by covering the venting hole, which is formed in the cover member, with the moisture-permeable waterproof membrane. Accordingly, a vent valve that is capable of preventing water entering from the outside and releasing internally-generated water vapor to the outside can be easily manufactured at low cost.

In the inverter-integrated electric compressor according to the above-described aspect, the moisture-permeable waterproof membrane may be a sealing structure and may be adhered to the cover member so as to cover the venting hole.

In this way, the vent valve can be constructed by bonding the moisture-permeable waterproof membrane having a sealing structure to the cover member so as to cover the venting hole. Accordingly, the assembly of the vent valve can be significantly simplified, and thus productivity can be improved.

In one of the above-described inverter-integrated electric compressors according to the above-described aspects, the vent valve may be disposed at a position away from a position opposing a board which constitutes the inverter device disposed inside the inverter accommodating section.

According to the above-described aspect, since the vent valve is provided at a position away from the position opposing the board constituting the inverter device, which is disposed inside the inverter accommodating section, even when the gel material thermally expands, the vent valve can be prevented from being closed early. In other words, since the board of the inverter device is provided at a position relatively close to the cover member, when the gel material on the board thermally expands, the gel material tends to adhere to the inner surface of the cover member, and the function of the vent valve is impaired. However, by providing the vent valve at a position away from the board, the function of the vent valve can be reliably maintained, regardless of the thermal expansion of the gel material. Even if the vent valve is damaged, damage to the board can be prevented.

In one of the above-described inverter-integrated electric compressors according to the above-described aspects, the gel material may be filled leaving an air layer with a predetermined ratio with respect to the inner volume of the inverter accommodating section so that the gel material does not adhere to the inner surface of the cover member when thermal expansion occurs.

According to the above-described aspect, since the gel material is filled leaving an air layer with a predetermined ratio with respect to the inner volume of the inverter accommodating section such that the gel material does not adhere to the inner surface of the cover member when thermal expansion occurs, the thermally expanded gel material can be prevented from being pressed against the inner surface of the cover member under thermal cycling conditions normally required for vehicles. In this way, breaking of the seal provided by the cover member and damage to components constituting the inverter device caused when the thermally expanded gel material is pressed against the cover member can be reliably prevented.

In one of the above-described inverter-integrated electric compressors according to the above-described aspects, a component which is a structural component disposed inside the inverter accommodating section and which has a space where the gel material may be enclosed in the interior thereof has an air vent port above the internal space.

According to the above-described aspect, since the structural component that has an internal space, which is disposed inside the inverter accommodating section, has an air vent port above this internal space, when the gel material is filled (the filled gel material is liquid when filled), the air inside the inner space in the structural component can be pushed out from the air vent port as the liquid surface of the gel material gradually rises from the bottom surface of the inverter accommodating section. Therefore, deformation and/or damage of the structural component caused by air trapped inside the inner space of the structural component can be reliably prevented.

In one of the above-described inverter-integrated electric compressors according to the above-described aspects, the cover member may be constructed of a high-damping steel sheet.

As described above, by constructing the cover member with the high-damping steel sheet, the vibration of the vehicle and the vibration of the electric compressor that are transmitted to the cover member of the inverter accommodating section via the compressor housing can be absorbed, and vibrations caused by the vibrations applied to the cover member can be suppressed. Therefore, noise generated at the cover member, acting as a vibration radiating surface, can be reduced.

In the above-described inverter-integrated electric compressors according to the above-described configurations, the high-damping steel sheet may include a rubber layer or a resin layer, and the vent valve may be constructed by adhering the moisture-permeable waterproof membrane to the rubber layer or resin layer.

In this way, since the vent valve is constructed by adhering the moisture-permeable waterproof membrane to the rubber or resin layer constituting the high-damping steel sheet, the adhesiveness of the moisture-permeable waterproof membrane is improved, and separation thereof can be prevented. The high-damping steel sheet has a configuration in which the rubber or resin layer is interposed between steel sheets or in which one or both sides of a steel sheet is coated with the rubber or resin layer. By adhering the moisture-permeable waterproof membrane by using the rubber or resin layer, the moisture-permeable waterproof membrane can be firmly adhered, and thus, the durability of the vent valve can be increased.

In one of the above-described inverter-integrated electric compressors according to the above-described configurations, at least one surface of the high-damping steel sheet may be a metal surface or a surface coated with an electrically conductive material, and the electric potential may be the same as the inverter accommodating section integrated with the housing.

In this way, because at least one side of the high-damping steel sheet is a metal surface or an electrically conductive material coated surface and can be set to the same electrical potential as that of the inverter accommodating section integrated with the housing, electric noise can be suppressed. Therefore, electrical noise in the inverter device can be reduced, and controllability can be improved.

According to the present invention, by using the vent valve that is composed of the moisture-permeable waterproof membrane, water vapor and the internal pressure generated inside the inverter accommodating section can be released to the outside while preventing water from entering from the outside into the inverter accommodating section.

Therefore, breaking of the seal provided by the cover member and damage to the components constituting the inverter device due to stress generated when thermal expansion of the gel material filled for vibration prevention and moisture prevention can be prevented, and the reliability of the inverter-integrated electric compressor can be improved.

EXPLANATION OF REFERENCE SIGNS

Figure 1:
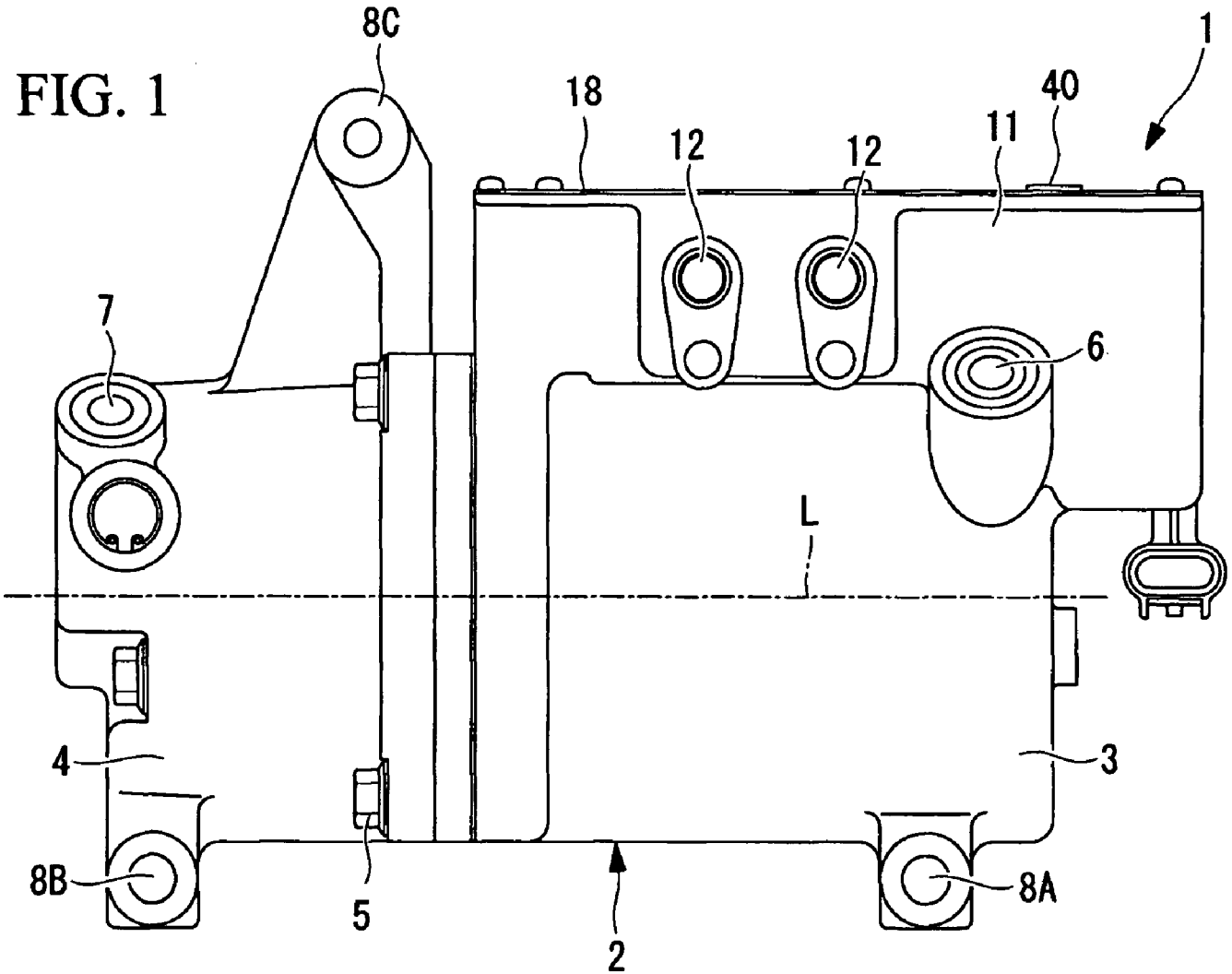
FIG. 1 is an external side view of an inverter-integrated electric compressor according to a first embodiment of the present invention.

1: inverter-integrated electric compressor
2: housing
11: inverter accommodating section
18: cover member
20: inverter device
23A: board
30: gel material
31: air layer
40: vent valve
41: venting hole
42: moisture-permeable waterproof membrane
50: structural component (terminal block)
50A: inner space
51: air vent port
60: high-damping steel sheet
60A: steel sheet
60B: rubber or resin layer

BEST MODE FOR CARRYING OUT THE INVENTION

Embodiments of the present invention will be described below with reference to the drawings.

First Embodiment

A first embodiment of the present invention will be described with reference to FIGS. 1 to 5.

FIG. 1 is an external side view of an inverter-integrated electric compressor 1 according to the first embodiment of the present invention. The inverter-integrated electric compressor 1 includes a housing 2 constituting the outer casing thereof. The housing 2 is constructed by tightly securing a motor housing 3 accommodating an electric motor 9 (see FIG. 2) and a compressor housing 4 accommodating a compressing mechanism (not shown) with a bolt 5 to form an integrated unit. The motor housing 3 and the compressor housing 4 are formed by aluminum die-casting.

The electric motor 9 and the compressing mechanism (not shown) disposed inside the housing 2 are connected with a motor shaft 10 (see FIG. 2), and the compressing mechanism is driven by the rotation of the electric motor 9. A suction port 6 is provided at the rear end of the motor housing 3 (right side in FIG. 1). Low-pressure refrigerant gas sucked into the motor housing 3 through the suction port 6 flows around the electric motor 9 and is then sucked into the compressing mechanism, where it is compressed. The high-temperature high-pressure refrigerant gas compressed at the compressing mechanism is discharged into the compressor housing 4 and is then discharged to the outside through a discharge port 7 provided at the front end (left side in FIG. 1) of the compressor housing 4.

The housing 2 has attachment legs 8A, 8B, and 8C provided at three locations in total: two at the lower section of the rear side (right side in FIG. 1) of the motor housing 3 and the lower section of the front side (left side in FIG. 1) of the compressor housing 4; and one at the upper section of the compressor housing 4. The inverter-integrated electric compressor 1 is mounted by securing attachment legs 8A, 8B, and 8C to the side wall etc. of a driving engine mounted in an engine compartment of a vehicle with a bracket and bolts. The inverter-integrated electric compressor 1 is usually cantilevered at three points on the upper and lower sides with a securing bracket such that the motor shaft direction L is in the front-to-back direction or the right-to-left direction.

Figure 2:
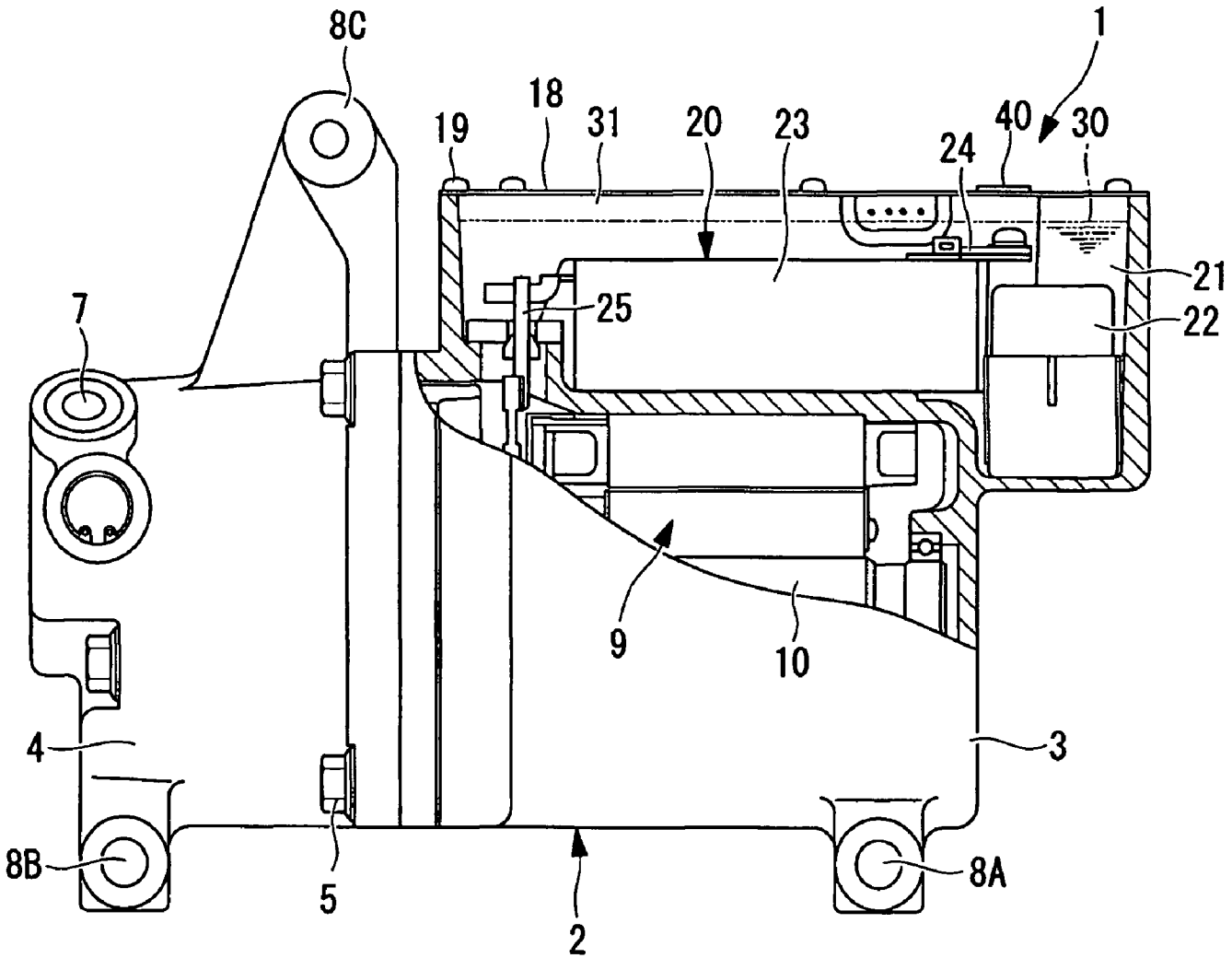
FIG. 2 is a partial longitudinal sectional view across the inverter accommodating section of the inverter-integrated electric compressor shown in FIG. 1.
Figure 3:
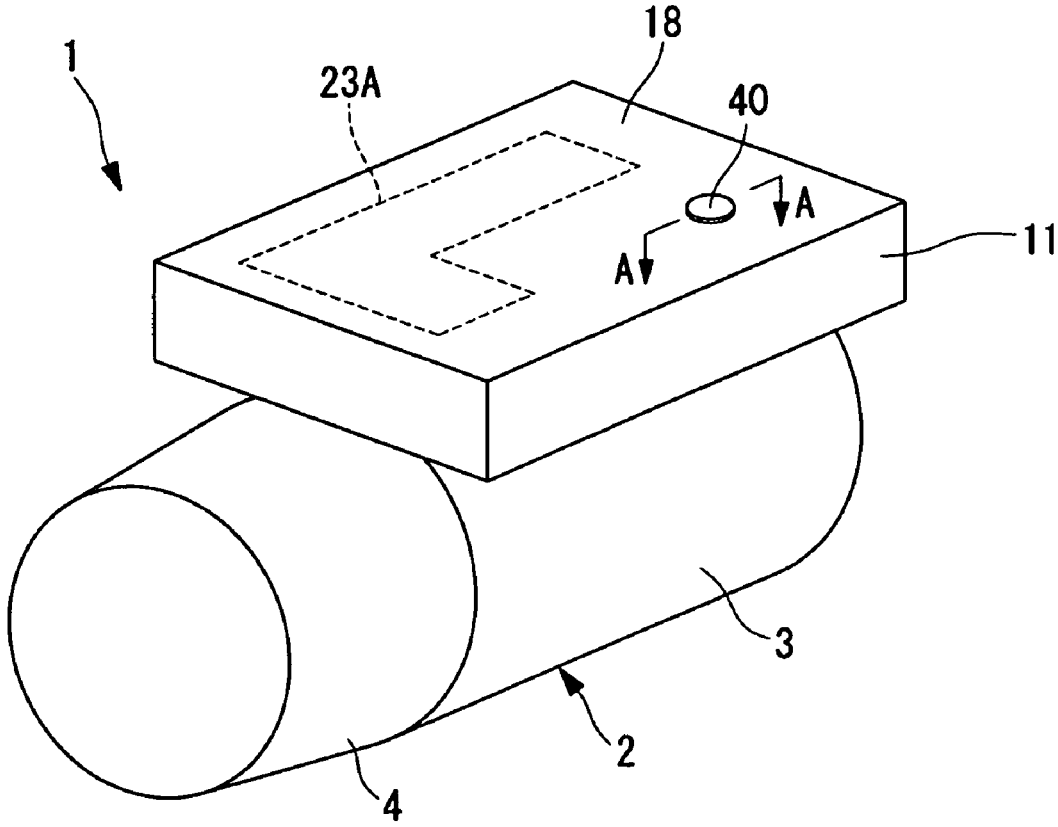
FIG. 3 is a perspective view, in outline, of the inverter-integrated electric compressor according to the first embodiment of the present invention.

A box-shaped inverter accommodating section (invert box) 11 is integrated with the peripheral section of the motor housing 3 at the upper section of the motor housing 3. FIG. 2 is a partial longitudinal sectional view across the inverter accommodating section 11. As shown in FIGS. 2 and 3, the inverter accommodating section 11 is shaped like a box open at the top and surrounded by a circumferential wall having a predetermined height. The upper opening is sealed with a cover member 18 secured with screws 19 with a sealing member (not shown) therebetween. Two power-supply-cable lead-out holes 12 are provided on the side surface of the inverter accommodating section 11 so that a power supply, such as a generator or a battery, and an inverter device 20 mounted inside the inverter accommodating section 11 can be connected via a power-supply cable (not shown).

The inverter device 20 mounted inside the inverter accommodating section 11 includes, for example, P-N terminals (not shown) to be connected to the power-supply cable; a high-voltage components, such as a head capacitor 21 and an inductor 22; an inverter module 23 that forms the core of the inverter device 20; a bus-bar assembly 24 including a plurality of integrated bus bars, which constitute the electrical wiring inside the inverter device 20, and being composed of insert-molded insulating resin material; and a motor terminal 25 that supplies a three-phase AC power, which is converted at the inverter device 20, to the electric motor 9. The inverter module 23 is a module formed of a power board, which is provided with a plurality of semiconductor power switching devices (insulated gate bipolar transistors (IGBTs)) (not shown) and a power-system controlling circuit for operating the semiconductor power switching devices, and a CPU board, on which is mounted a circuit having devices operating at low voltage, such as a central processing unit (CPU). An outline of the boards is illustrated in FIG. 3 with a broken line and is indicated as a board 23A.

Figure 5:
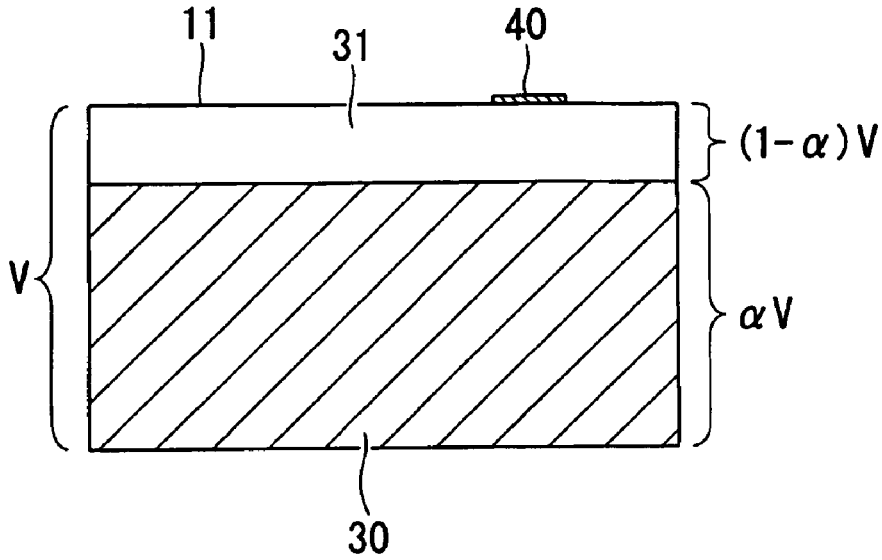
FIG. 5 illustrates the infill state of a gel material in an inverter accommodating section of the inverter-integrated electric compressor shown in FIG. 1.

A gel material 30 for insulation, vibration prevention, and moisture prevention, which is, for example, composed of a silicone gel, fills the inside of the inverter accommodating section 11 to a level indicated by a two-dot chain line in FIG. 2 or, in other words, to a level that ensures an air layer 31 sufficient for preventing the gel material 30 from attaching to the inner surface of the cover member 18 when thermal expansion of the gel material 30 occurs. More specifically, as shown in FIG. 5, the gel material 30 is filled to a volume no more than $\alpha V$, and the volume of the air layer 31 is the remaining $(1-\alpha)V$, where V represents the total volume inside the inverter accommodating section 11 (including the volume in the cover member 18 when part of the volume is formed in the cover member 18), and $\alpha$ represents the volumetric ratio of the gel material 30 to the total volume V.

The infill amount of the gel material 30 is determined by taking into consideration the rate of volume expansion k and the upper temperature limit allowable under the required heat cycling conditions. If the air is treated as an ideal gas and the gel material 30 is incompressible, the volume of the gel material 30 varies due to a temperature change $\Delta T$ as defined by the following equation:

$$Vg=(1+k\Delta T)VgO$$

If the gel material 30 is considered to be incompressible, the change in volume of the gel material 30 equals the change in volume of air, and thus, according to the ideal gas equation:

$$pVa/T = pOVaO/TO$$

$$\begin{aligned}\therefore p &= (VaO/Va)(T/TO)pO \\ &= ((1-\alpha)V/V-Vg))(T/TO)pO \\ &= ((1-\alpha)/1-(1+k\Delta T)\alpha))(T/TO)pO\end{aligned}$$

In the above, if p/pO exceeds the pressure-resistant capacity of a sealing material, where pO represents the atmospheric pressure, TO represents the infill temperature of the gel material 30, and T represents the increased temperature, the cover member 18 seal is broken. When p/pO is infinite, the air layer 31 can be considered as zero, i.e., the gel material 30 is adhered to the cover member 18. For example, when silicone gel is used as the gel material 30 and the allowable temperature under normally required heat cycling conditions is 125° C., the volumetric ratio of the gel material 30 and the air layer 31 to the total volume V inside the inverter accommodating section 11 may be set to approximately 9:1, taking into consideration the volume expansion rate of the silicone gel, and an air layer of 10% or more should be maintained.

Figure 4:
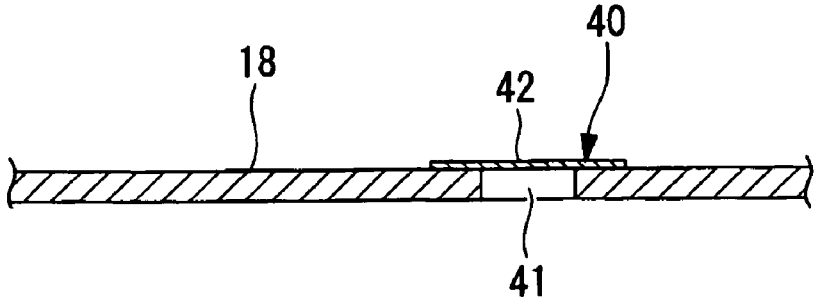
FIG. 4 is a sectional view taken along line A-A in FIG. 3.

As shown in FIGS. 3 to 5, the cover member 18 that seals the inverter accommodating section 11 is provided with a vent valve 40. The vent valve 40 seals a venting hole 41 formed in the cover member 18. The vent valve 40 is composed of a moisture-permeable waterproof membrane 42 that allows air and water vapor to pass through and that does not allow water to pass through. The vent valve 40 is mounted by providing the moisture-permeable waterproof membrane 42 as a sealing structure and adhering to the surface of the cover member 18 so as to cover the venting hole 41. Typical examples of the moisture-permeable waterproof membrane 42 constituting the vent valve 40 are Gore-Tex (trademark), manufactured by W. L. Gore & Associates, Inc. in the USA, which is a porous fluorocarbon resin membrane composed by hybridizing polytetrafluoroethylene (PTFE) and polyurethane polymers, and DiAPLEX (trademark), manufactured by Diaplex Co. Ltd., which is a polyurethane based shape-memory resin.

As shown in FIG. 3, the vent valve 40 is disposed at a position away from a position opposing the board (power board and CPU board included in the inverter module 23) 23A, indicated by the broken line, constituting the inverter device 20 disposed inside the inverter accommodating section 11, i.e., disposed at a position where components of the inverter device 20 are not disposed close to the inner side of the inverter accommodating section 11.

According to the above-described configuration, the following advantages are achieved with this embodiment.

Vibrations generated while driving the vehicle and radiation heat from the peripheral sections, where the temperature becomes high, are transmitted to the inverter-integrated electric compressor 1 mounted inside the engine compartment of the vehicle. Such vibrations and heat are also transmitted to the inverter device 20, which is disposed inside the inverter accommodating section 11, via the inverter accommodating section 11 integrated with the housing 2. The gel material 30 fills the inside of the inverter accommodating section 11. The gel material 30 provides insulation protection, anti-vibration protection, and moisture protection to the inverter device 20 so as to provide durability and reliability for the use environment. The above-described heat and the heat generated from power-related components in the inverter device 20 are removed by taking the heat in from the suction port 6 to the housing 2 and transmitting the heat through the housing wall to the low-pressure refrigerant gas, which flows around the electric motor 9. In this way, the inverter device 20 is cooled.

When thermal expansion of the gel material 30 occurs, the thermal expansion of the gel material 30 can be absorbed by providing the air layer 31 inside the inverter accommodating section 11 at a predetermined ratio with respect to the internal volume of the inverter accommodating section 11 such that the gel material 30 does not adhere to the inner surface of the cover member 18 of the inverter accommodating section 11. Therefore, water drops are generated in the air layer 31 due to condensation at low temperatures. When the ambient temperature is high, thermal expansion occurs in the air in the air layer 31 and the gel material 30 and the water drops evaporate into water vapor, causing the internal pressure inside the inverter accommodating section 11 to rise.

In this embodiment, since the vent valve 40 composed of the moisture-permeable waterproof membrane 42, which allows air and water vapor to pass through but does not allow water to pass through, is provided on the cover member 18, which seals the inverter accommodating section 11, the internal pressure and water vapor can be released to the outside through the moisture-permeable waterproof membrane 42 of the vent valve 40 while preventing water from intruding from the outside into the inverter accommodating section 11. In this way, a rise in the internal pressure of the inverter accommodating section 11 can be suppressed. Therefore, an appropriate amount of gel material 30 can be filled to sufficiently provide the original functions of insulation, vibration prevention, and moisture prevention, and at the same time, breaking of the seal provided by the cover member 18 and damage to various components constituting the inverter device 20 due to stress generated when thermal expansion of the gel material 30 and the air in the air layer 31 occurs can be prevented. Accordingly, the reliability of the inverter-integrated electric compressor 1 can be improved.

The vent valve 40 is composed by sealing the venting hole 41 formed in the cover member 18 with the moisture-permeable waterproof membrane 42 and is installed by adhering the moisture-permeable waterproof membrane 42 having a sealing structure on the cover member 18 so as to cover the venting hole 41. Accordingly, the vent valve 40 that is capable of preventing water from entering from the outside and releasing internally-generated water vapor and pressure to the outside can be easily manufactured at low cost, and, at the same time, the assembly of the vent valve 40 can be significantly simplified, thus improving productivity.

The vent valve 40 is disposed at a position away from a position opposing the board 23A constituting the inverter device 20. Therefore, even if thermal expansion of the gel material 30 on the board 23A occurs and the gel material 30 adheres to the inner surface of the cover member 18, the function of the vent valve 40 can be maintained. In other words, because the board 23A of the inverter device 20 is provided at a position relatively close to the cover member 18, the gel material 30 on the board 23A tends to adhere to the inner surface of the cover member 18 when thermal expansion occurs. However, by providing the vent valve 40 away from the board 23A, the vent valve 40 can be prevented from being closed by the gel material 30 early. Therefore, the function of the vent valve 40 is maintained, and damage to the board 23A can be suppressed even when the vent valve 40 is damaged.

To prevent the gel material 30 from adhering to the inner surface of the cover member 18 when thermal expansion occurs, the volume ratio of the gel material 30 to be filled and the air layer 31 is determined by taking into consideration the internal volume of the inverter accommodating section 11 and the volume expansion rate of the gel material 30. Then, the gel material 30 is filled such that the air layer 31 with a predetermined ratio is provided. Accordingly, the thermally expanded gel material 30 can be prevented from adhering to the inner surface of the cover member 18 under the thermal cycling conditions normally required for vehicles. As a result, the gel material 30 can be filled to sufficiently provide the functions of insulation, vibration prevention, and moisture prevention, and at the same time, breaking of the seal provided by the cover member 18 and damage to various components constituting the inverter device 20 caused when the thermally expanded gel material 30 is pressed against the cover member 18 can be reliably prevented.

Second Embodiment

Next, a second embodiment of the present invention will be described with reference to FIG. 6.

This embodiment differs from the above-described first embodiment in that a countermeasure against thermal expansion of the gel material 30 is provided for a structural component 50 mounted inside the inverter accommodating section 11. Since other aspects are the same as those according to the first embodiment, descriptions thereof are omitted.

Figure 6:
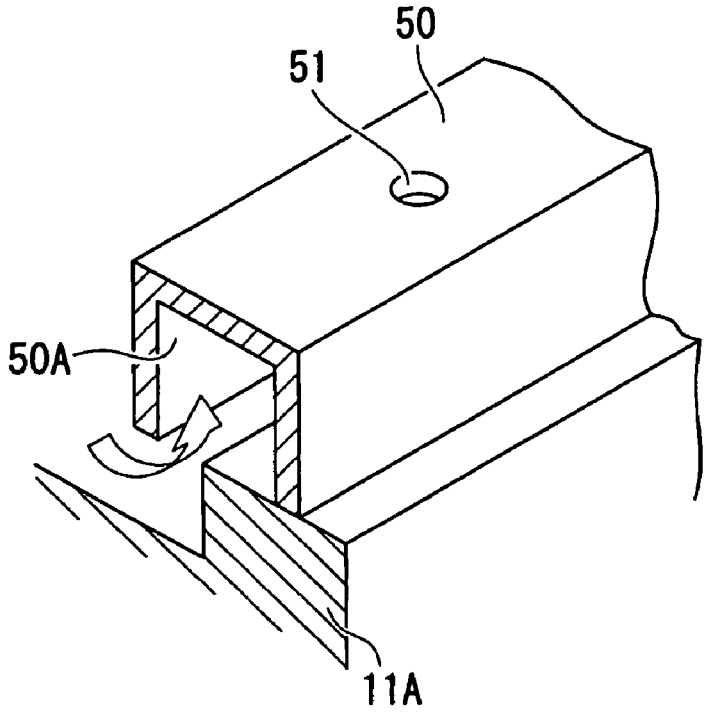
FIG. 6 is a partial perspective view of an example structural component disposed inside an inverter accommodating section of an inverter-integrated electric compressor according to a second embodiment of the present invention.

As shown in FIG. 6, this embodiment provides the structural component 50 mounted inside the inverter accommodating section 11. In particular, the structural component 50 has an inner space 50A where the gel material 30 is enclosed and an air vent port 51 formed above the inner space 50A.

An example of the structural component 50 is a terminal block (structural component 50) mounted inside the inverter accommodating section 11. The terminal block is a resin block used for installing metal terminals inside the inverter accommodating section 11 and is mounted with screws on a mounting base 11A inside the inverter accommodating section 11. Such a terminal block is formed of resin since insulation is required and has an inner space 50A that opens at the bottom for reducing the thickness. Therefore, when the gel material 30 is filled, the gel material 30 may enter the inner space 50A and trap air inside.

However, as described above, in this embodiment, since the air vent port 51 is formed above the inner space 50A in the terminal block, which is the structural component 50, when the gel material 30 is filled (the filled gel material 30 is liquid when filled), the air inside the inner space 50A in the structural component 50 can be pushed out from the air vent port 51 when the liquid surface of the gel material 30 gradually rises from the bottom surface of the inverter accommodating section 11. Therefore, deformation and/or damage of the structural component (terminal block) 50 due to air trapped inside the inner space 50A in the structural component 50 can be assuredly prevented.

Third Embodiment

A third embodiment of the present invention will be described with reference to FIGS. 7A and 7B.

The configuration of the cover member 18 of this embodiment differs from that of the above-described first embodiment. Since other aspects are the same as those according to the first embodiment, descriptions thereof are omitted.

Figure 7A:
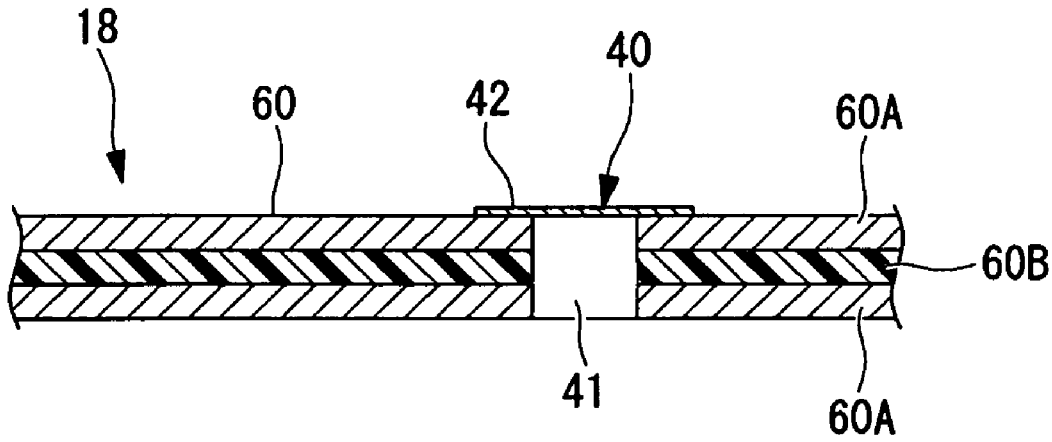
FIG. 7A is a sectional view of an example high-damping steel sheet constituting a cover member mounted to an inverter accommodating section of an inverter-integrated electric compressor according to a third embodiment of the present invention.
Figure 7B:
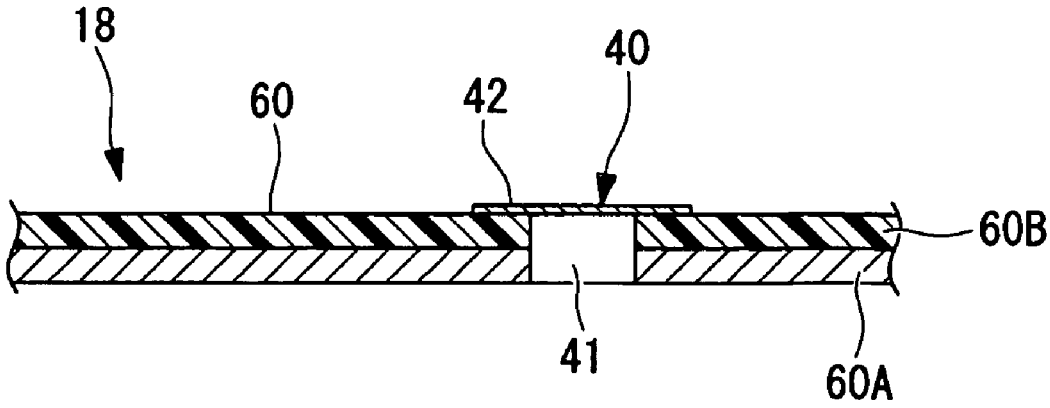
FIG. 7B is a sectional view of the example high-damping steel sheet constituting the cover member mounted to the inverter accommodating section of the inverter-integrated electric compressor according to the third embodiment of the present invention.

As shown in FIGS. 7A and 7B, in this embodiment, the cover member 18 is constructed of a high-damping steel sheet 60. The high-damping steel sheet 60 may be selected from various types of high-damping steel sheets such as one constructed by sandwiching a rubber or resin layer 60B with a plurality of steel sheets 60A, as shown in FIG. 7A, or one constructed by coating one side or both sides of a steel sheet 60A with a rubber or resin layer 60B, as shown in FIG. 7B.

Even when the cover member 18 is constructed of the above-described high-damping steel sheet 60, the vent valve 40 may be formed in the same manner as in the first embodiment. In such a case, the moisture-permeable waterproof membrane 42 constituting the vent valve 40 may be bonded to the steel sheet 60A, as shown in FIG. 7A, or may be bonded to the rubber or resin layer 60B, as shown in FIG. 7B. With the above-described high-damping steel sheet 60, it is preferable that at least one of the surfaces be a metal surface or at least one of the surfaces be a surface coated (or plated) with an electrically conductive material, and the electric potential be the same as that of the inverter accommodating section 11 integrated with the housing 2, which is the body of the inverter-integrated electric compressor 1.

As described above, by constructing the cover member 18 with the high-damping steel sheet 60, the vibration of the vehicle and the vibration of the inverter-integrated electric compressor 1 that are transmitted to the cover member 18 of the inverter accommodating section 11 via the housing 2 can be absorbed, and vibrations caused by the vibrations applied to the cover member 18 can be suppressed. Therefore, noise generated at the cover member 18, acting as a vibration radiating surface, can be reduced.

As shown in FIG. 7B, by constructing the vent valve 40 by adhering the moisture-permeable waterproof membrane 42 to the rubber or resin layer 60B constituting in the high-damping steel sheet 60, the adhesiveness of the moisture-permeable waterproof membrane 42 is improved, and separation thereof can be prevented. Therefore, the moisture-permeable waterproof membrane 42 can be strongly adhered, and the durability of the vent valve 40 can be improved.

By constructing at least one of the surfaces of the high-damping steel sheet 60 as a metal surface or as a surface coated with an electrically conductive material so that the electric potential is the same as the inverter accommodating section 11 integrated with the housing 2, electrical noise can be suppressed. Therefore, electrical noise in the inverter device 20 can be reduced, and controllability can be improved.

The present invention is not limited to the above-described embodiments, and various modifications may be made so long as they do not depart from the spirit of the invention. For example, since the amount of gel material 30 to be filled depends on the upper limit of the allowable temperature, the volumetric ratio is not limited to those in the above-described embodiments. In the embodiments, the moisture-permeable waterproof membrane 42 constituting the vent valve 40 is adhered to the surface of the cover member 18. Instead, however, the moisture-permeable waterproof membrane 42 may be adhered to the inner surface of the cover member 18 or to an intermediate layer when there are multiple layers. The compressing mechanism provided inside the compressor housing 4 is not limited, and any type of compressing mechanism, e.g., a rotary type, a scroll type, or a swash plate type, may be used.

The invention claimed is:

1. An inverter-integrated electric compressor in which an inverter accommodating section is integrated with a periphery of a housing accommodating an electric compressor, an inverter device is accommodated inside the inverter accommodating section, a gel material for vibration prevention and moisture prevention is filled in the upper section thereof so as to leave an air layer, and an upper opening in the inverter accommodating section is sealed with a cover member, wherein a vent valve formed of a moisture-permeable waterproof membrane is provided in the cover member, and wherein the vent valve is disposed at a position away from a position opposing a board which constitutes the inverter device accommodated inside the inverter accommodating section.

2. The inverter-integrated electric compressor according to claim 1, wherein the vent valve is configured so that a venting hole provided in the cover member is covered with the moisture-permeable waterproof membrane.

3. The inverter-integrated electric compressor according to claim 2, wherein the moisture-permeable waterproof membrane is a sealing structure and is adhered to the cover member so as to cover the venting hole.

4. The inverter-integrated electric compressor according to claim 1, wherein the gel material is filled to a predetermined ratio with respect to the inner volume of the inverter accommodating section leaving an air layer so that the gel material does not adhere to the inner surface of the cover member when thermal expansion occurs.

5. The inverter-integrated electric compressor according to claim 1, wherein a component which is a structural component disposed inside the inverter accommodating section and which has a space where the gel material is enclosed in the interior thereof has an air vent port above the internal space.

6. The inverter-integrated electric compressor according to claim 1, wherein the cover member is constructed of a high-damping steel sheet.

7. An inverter-integrated electric compressor in which an inverter accommodating section is integrated with a periphery of a housing accommodating an electric compressor, an inverter device is accommodated inside the inverter accommodating section, a gel material for vibration prevention and moisture prevention is filled in the upper section thereof so as to leave an air layer, and an upper opening in the inverter accommodating section is sealed with a cover member, wherein a vent valve formed of a moisture-permeable waterproof membrane is provided in the cover member, wherein the cover member is constructed of a high-damping steel sheet, and wherein the high-damping steel sheet includes a rubber layer or a resin layer, and the vent valve is constructed by adhering the moisture-permeable waterproof membrane to the rubber layer or resin layer.

8. The inverter-integrated electric compressor according to claim 6, wherein at least one surface of the high-damping steel sheet is a metal surface or a surface coated with an electrically conductive material, and the electric potential is the same as the inverter accommodating section integrated with the housing.

9. The integrated-inverter electric compressor according to claim 7, wherein at least one surface of the high-damping steel sheet is a metal surface or a surface coated with a conductive material, and the electric potential is the same as the inverter accommodating section integrated with the housing.

* * * * *